US007044817B2

(12) United States Patent
Bech

(10) Patent No.: US 7,044,817 B2
(45) Date of Patent: May 16, 2006

(54) ANCHORING SYSTEM

(75) Inventor: Arild Bech, Arendal (NO)

(73) Assignee: Advanced Production and Loading AS, Kolbjørnsvik (NO)

( * ) Notice: Subject to any disclaimer, the term of this patent is extended or adjusted under 35 U.S.C. 154(b) by 0 days.

(21) Appl. No.: 10/518,958

(22) PCT Filed: Jun. 12, 2003

(86) PCT No.: PCT/NO03/00193

§ 371 (c)(1),
(2), (4) Date: Aug. 18, 2005

(87) PCT Pub. No.: WO03/106253

PCT Pub. Date: Dec. 24, 2003

(65) Prior Publication Data

US 2006/0011123 A1 Jan. 19, 2006

(30) Foreign Application Priority Data

Jun. 17, 2002 (NO) ..... 20022892

(51) Int. Cl.
*B63B 22/02* (2006.01)

(52) U.S. Cl. ..... 441/5; 441/3; 441/4

(58) Field of Classification Search ..... 441/3–5
See application file for complete search history.

(56) References Cited

U.S. PATENT DOCUMENTS 3,641,602 A * 2/1972 Flory et al. ..... 441/5
3,840,927 A * 10/1974 Reid, Jr. ..... 441/5
3,979,785 A * 9/1976 Flory ..... 441/5
6,558,215 B1 * 5/2003 Boatman ..... 441/5

FOREIGN PATENT DOCUMENTS

DE 2610812 A * 9/1977

* cited by examiner

*Primary Examiner*—Jesus D. Sotelo
(74) *Attorney, Agent, or Firm*—Jeffrey Pearce

(57) ABSTRACT

Anchoring system to hold a vessel anchored during loading or unloading, which vessel can be connected to or from the anchoring system in a similar way under all operating conditions without adjustments in the anchoring system, which anchoring system is comprising one or more anchors, from each anchor an anchor line is arranged extending upwards through the sea to a subsea buoy with swivel, which buoy has connected thereto and suspended the anchor lines and at least one pipeline for loading or unloading up through the sea, from which subsea buoy at least one line is arranged to a surface buoy, and further, at least one anchoring line and at least one pipeline for loading or unloading, arranged to the vessel either directly from the subsea buoy or via the surface buoy to the vessel, distinguished in that in each anchor line slack is arranged, and on one or more anchor-lines one or more clump weights are arranged, and the buoyancy of the subsea buoy and the buoyancy of the surface buoy is adapted such that by damage on the surface buoy or the line therefrom to the subsea buoy will the subsea buoy and thereto suspended equipment not be lowered further down vertically than that one or more of the clump weights are landing on the seabed, while during loading or unloading will at least one of the clump weighs on each anchor line be located on or just above the seabed, and for all types of load in the loading and unloading pipelines and with all anchor lines connected, the subsea buoy can by ballast adjustment be brought up to the surface.

9 Claims, 7 Drawing Sheets

ANCHORING SYSTEM

FIELD OF THE INVENTION

The present invention regards an anchoring system, more specific an anchoring system with which a vessel can lie anchored while loading or unloading through pipelines, for example arranged in connection to an oil-field.

With the anchoring system according to the present invention a vessel can connect or disconnect the anchoring system to load or unload, in an identical way for all types of loading or unloading, independent on whether the pipelines are filled with a heavy medium such as oil or water or a light medium such as gas.

BACKGROUND OF THE INVENTION AND PRIOR ART

A number of anchoring systems are known with which a vessel can lie anchored while loading for example crude oil from an oilfield connected by one or more pipelines.

For use in deep water it is in particular beneficial to use an anchoring system with a subsea buoy anchored to the seabed. A common feature for all anchoring systems of said type is that the forces acting on the anchor lines and the loading/unloading pipelines are reduced due to the use of a subsea buoy, because the impact of weather and wind decreases as the water depths increase. Further, the vessels will if the subsea buoy is located deeper than the draught of the vessels, not collide with the subsea buoy. The connection to the vessel from the subsea buoy, for the anchoring and/or loading/unloading pipeline, is either via a surface buoy or directly between the vessel and the subsea buoy. Anchoring systems for which the loading pipeline and the anchoring per se are separated all the way from the seabed to the vessel are also known (ref: APL's SAL). Someg examples on anchoring systems of the above mentioned types are found in the patent publications U.S. Pat. No. 5,816,183, FR 2344442, DE 2752266 and NO 1999 1985.

Despite the above mentioned prior art a demand still exists for an anchoring system with which the subsea buoy can be lifted to the surface with all anchoring lines and loading lines connected, with all types of media in the loading lines, by relatively simple means. A demand also exists for an anchoring system that allows for a vessel to connect or disconnect in a similar way independent of which load that is to be loaded or unloaded, which means that the anchoring system can handle variations in buoyancy caused by variations or changes in the loading medium. Said variations in buoyancy can amount to several hundred metrical tons. A demand also exists for an anchoring system with a surface buoy constructed so that if the surface buoy is damaged or fails the subsea buoy and the below suspended elements will be deployed only a relatively short distance down into the sea, typically less than 20 meters.

SUMMARY OF THE INVENTION

With the present invention the above-mentioned demands are met in that an anchoring system is provided to keep a vessel anchored during loading or unloading, which vessel can connect or disconnect from the anchoring system in a similar way under all operating conditions without adjustments in the anchoring system, which anchoring system is comprising one or more anchors, from each anchor an anchoring line is arranged, extending upwards through the sea to a subsea buoy with swivel, which buoy has connected thereto and holds the anchoring lines and least one pipeline for loading or unloading upwards through the sea, from which subsea buoy at least one line is arranged to a surface buoy, and further, at least one anchoring line and at least one pipeline for loading or unloading, arranged to the vessel either directly from the subsea buoy or via the surface buoy to the vessel.

The anchoring system according to the present invention is distinguished in that in each anchoring line slack is arranged, and on one or more anchor lines it is arranged one or more clump weights, the buoyancy of the subsea buoy and the buoyancy of the surface buoy is adapted such that by damage on the surface buoy or the line therefrom to the subsea buoy will the subsea buoy and equipment suspended therein not be deployed lower down vertically than that one or more of the clump weights are landing on the seabed, while under loading or unloading will at least one of the clump weights on the anchor lines be located on or just above the seabed, and for all types of load in the loading and unloading pipelines and with all anchor lines connected can the subsea buoy by ballast adjustment be brought up to the surface.

The anchoring system according to the invention is preferably comprising six anchors with anchor line from each anchor up to the subsea buoy, arranged by spread anchoring, with two clump weights on at least four of the anchor lines, such that under all loading or unloading will, for each anchor line with clump weights, one clump weight lie on the seabed while one clump weight is raised a short distance above the seabed.

The loading/unloading lines and the anchor line are the preferably arranged from the subsea buoy to the surface buoy and therefrom to the vessel, due to handleability.

The location of the lowest position and highest normal position of the subsea buoy during loading and unloading, is preferably vertically within about 5 meters, because this is within the capacity of the surface buoy.

The subsea buoy is preferably ballastable by passing in/out air or water, controlled from the surface via cable or acoustic signals from the surface buoy.

The surface buoy is preferably ballastable by passing ill/out air or water.

The subsea buoy is preferably located deeper than the largest draught for vessels that are to use the anchoring system, to avoid risk of collisions.

The maximum allowable variation in buoyancy for loading/unloading lines that can be handled by the anchoring system according to the present invention is preferably at least about 200000 kg.

With the term surface buoy it is primarily meant a surface breaking buoy with buoyancy, but also a device in or close to the surface that can be brought up from the surface. Accordingly, the term surface buoy also includes the devices over the subsea buoy according to patent publication U.S. Pat. No. 5,816,183 (SBM). In embodiments without any regular surface buoy, such as according to the above mentioned US-patent, the anchor line and the loading/unloading pipelines will be arranged directly from the subsea buoy to the vessel.

For embodiments with a regular surface buoy the anchor line from the subsea buoy in the direction of the vessel and the line from the subsea buoy to the surface buoy will most preferably be one and the same line, which is meant to be included in the term "at least one line" from the subsea buoy to a surface buoy.

DRAWINGS

FIG. 1 illustrates the anchoring system according to the present invention, connected to a production platform and a vessel that lies anchored and is loading.

FIG. 2 further illustrates details of the upper part of the anchoring system according to the invention, with a vessel connected, viewed from the side, FIG. 3 illustrates the same as FIG. 2, but viewed from above, FIG. 4 is a further enlarged drawing of the upper part of an anchoring system according to the invention, where the subsea buoy and surface buoy, and the connections in between, appear clearly.

DETAILED DESCRIPTION

Figure 1:
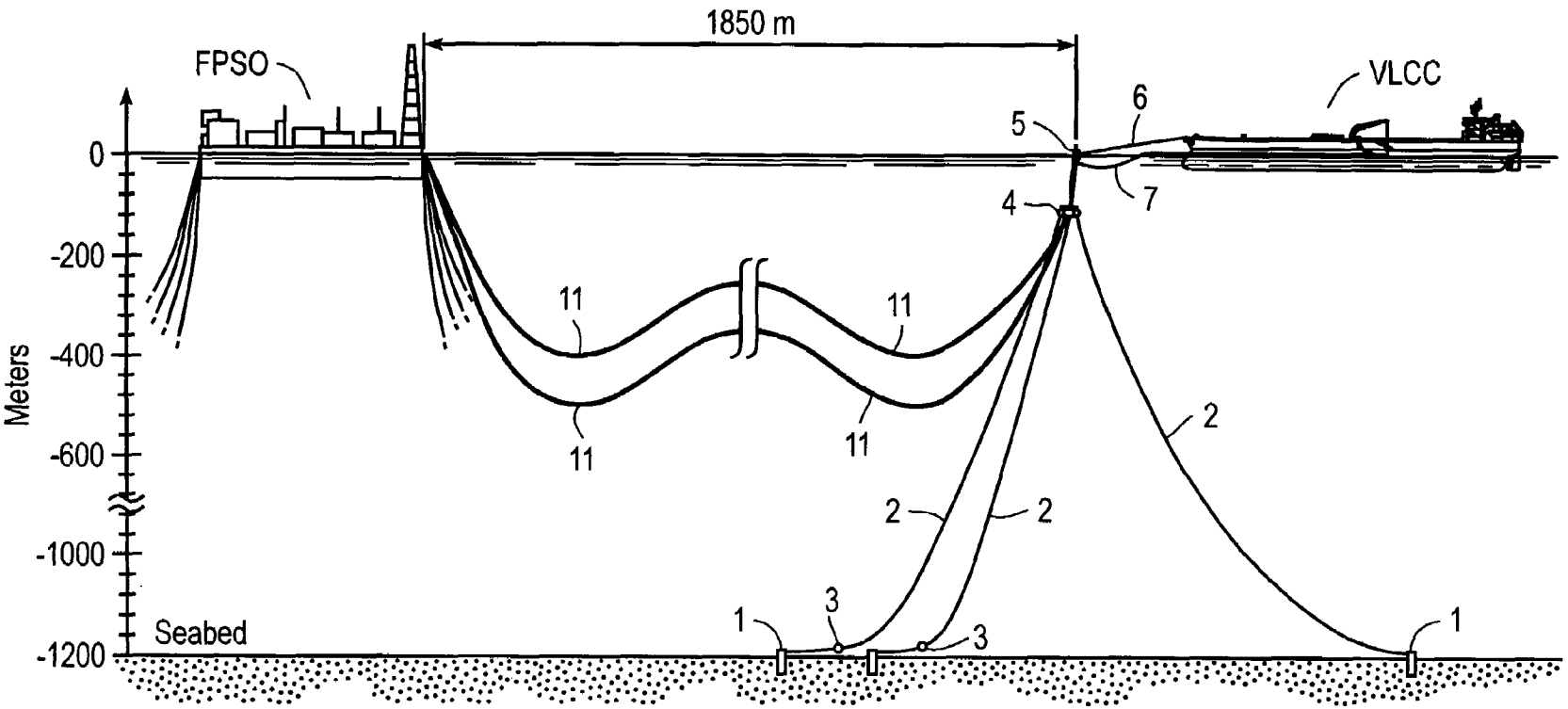
Figure 2:
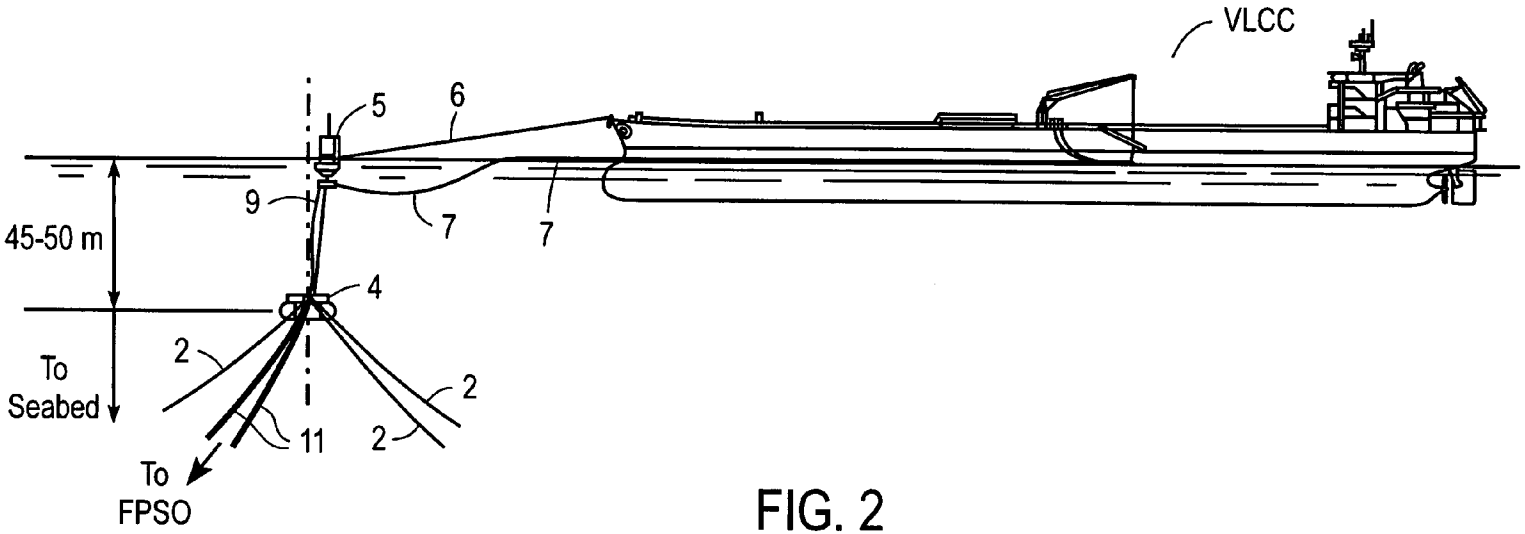
Figure 3:
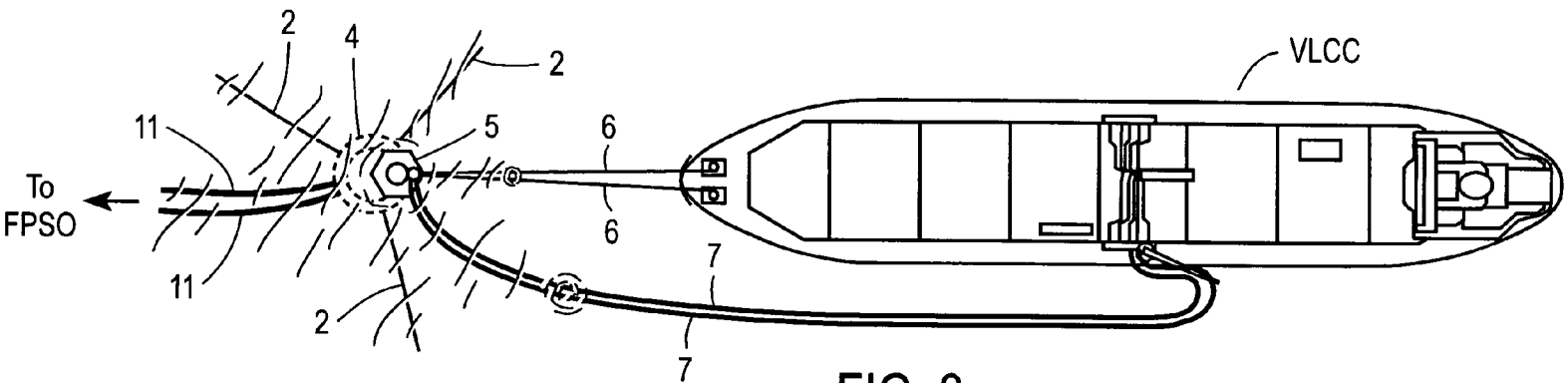

Reference is made to FIG. 1, where an embodiment of an anchoring system according to the invention is illustrated, connected to a production platform (FPSO) and a vessel (VLCC). On the figure the anchors 1 and three anchor lines 2 are illustrated. On two of the anchor lines a clump weight 3 is indicated. The anchor lines are suspended in a subsea buoy 4. In the subsea buoy 4 also two export pipelines 11 are suspended. Via an anchor line and a loading pipeline (not clearly apparent from FIG. 1) the subsea buoy is connected to a surface buoy 5. From the surface buoy an anchor line 6 and loading pipelines 7 are illustrated. Reference is made to FIGS. 2 and 3, which in more detail illustrate the upper parts of the anchoring system according to the invention as illustrated on FIG. 1. On the FIGS. 2 and 3 the subsea buoy 4 appears clearly, in addition to the anchor line 6 and loading pipelines 7. It appears from FIG. 3 that two loading pipelines are provided, which are floating in the part closest to the vessel. On FIG. 2 the surface buoy 5 appears clearly, which is not that visible on FIG. 3 that is viewed as from above. As apparent both from FIG. 2 and FIG. 3 a total of six anchor lines are provided, which are marked with reference numbers 2 on FIG. 3. On FIG. 2 the anchor line 8 between the subsea buoy and the surface buoy can be viewed, in addition to the loading pipeline 9 between the subsea buoy and the surface buoy.

Figure 4:
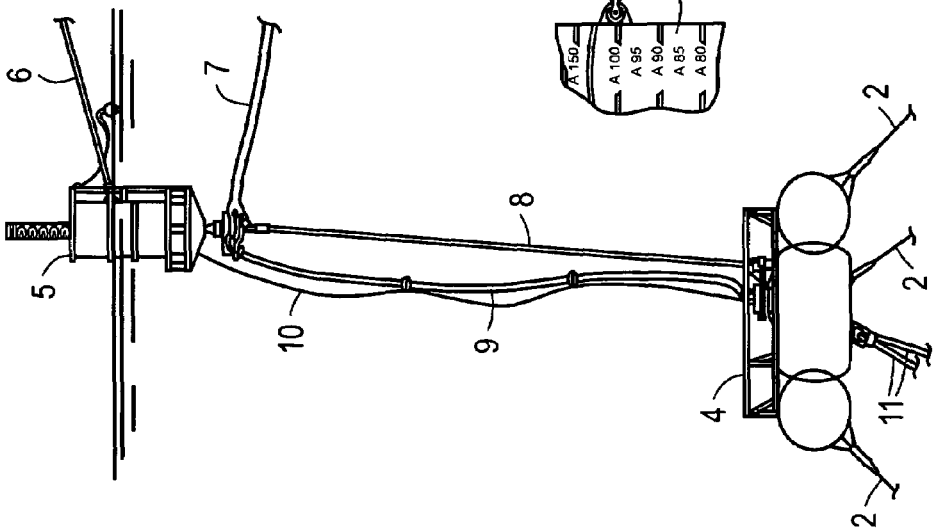

On FIG. 4, that is a further enlarged drawing of the upper parts of the anchoring system according to the invention as illustrated on FIGS. 1 to 3, similar parts are marked with similar reference numbers. In addition an umbilical 10 between the surface buoy and the subsea buoy is illustrated, arranged for transfer of air, signals and power.

Figure 5:
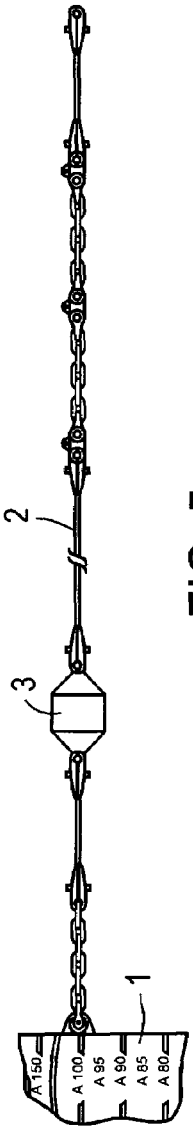
FIG. 5 illustrates the anchoring line towards the anchor, with clump weight included.

Reference is further made to FIG. 5 where part of an anchor 1 is indicated, more specific a part of a suction anchor or a pile anchor, and the lower part of an anchor line 2 with a clump weight 3.

Figure 6:
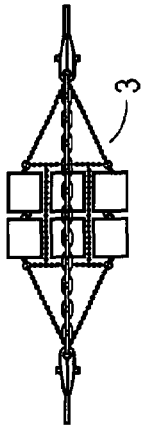
FIG. 6 illustrates the clump weight illustrated on FIG. 5, in more detail.

The clump weight is further illustrated on FIG. 6.

Figure 7:
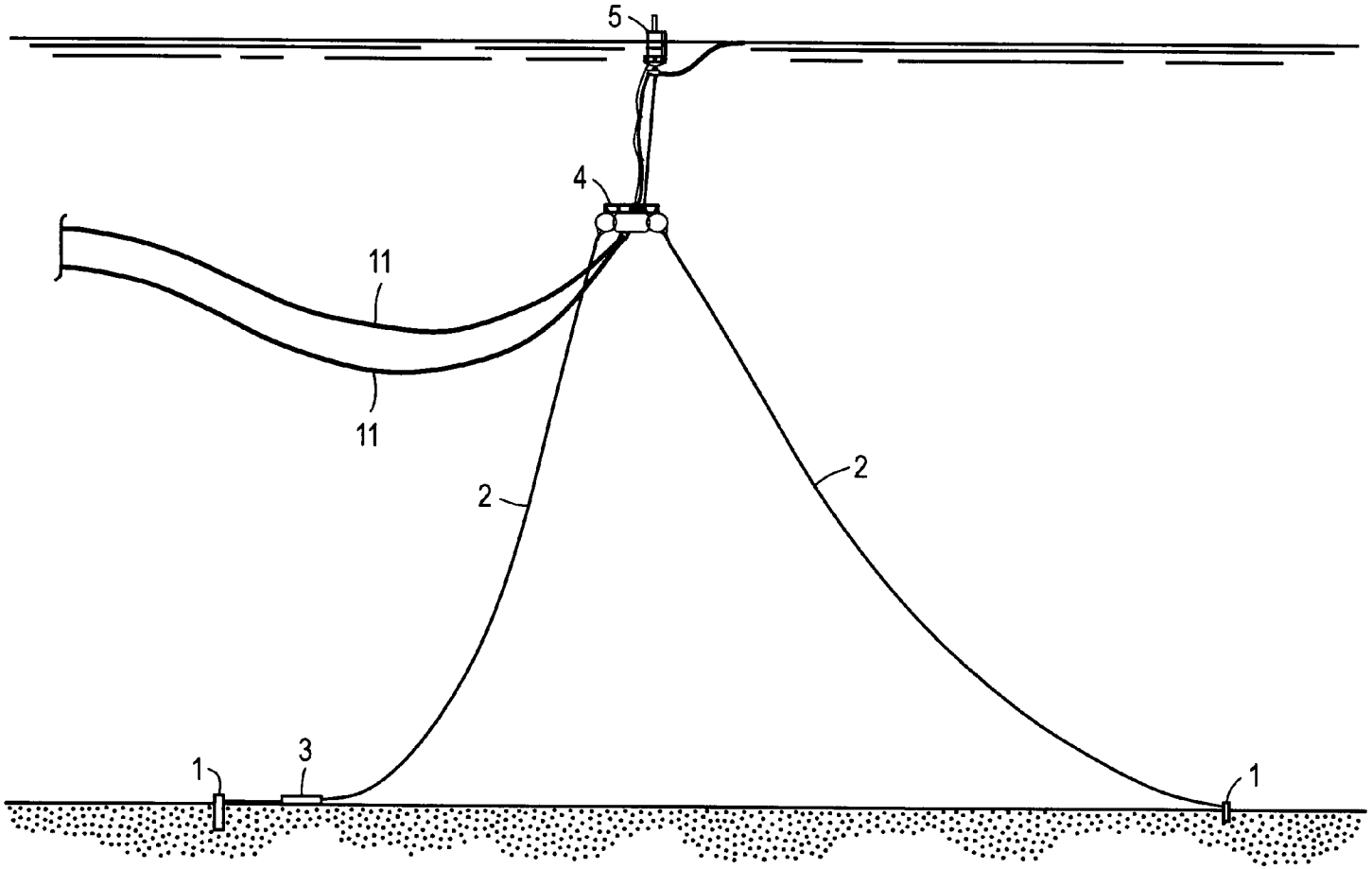
FIG. 7–9 illustrate how clump weights are raised from the seabed while the subsea buoy is lifted to the surface by ballasting.
Figure 8:
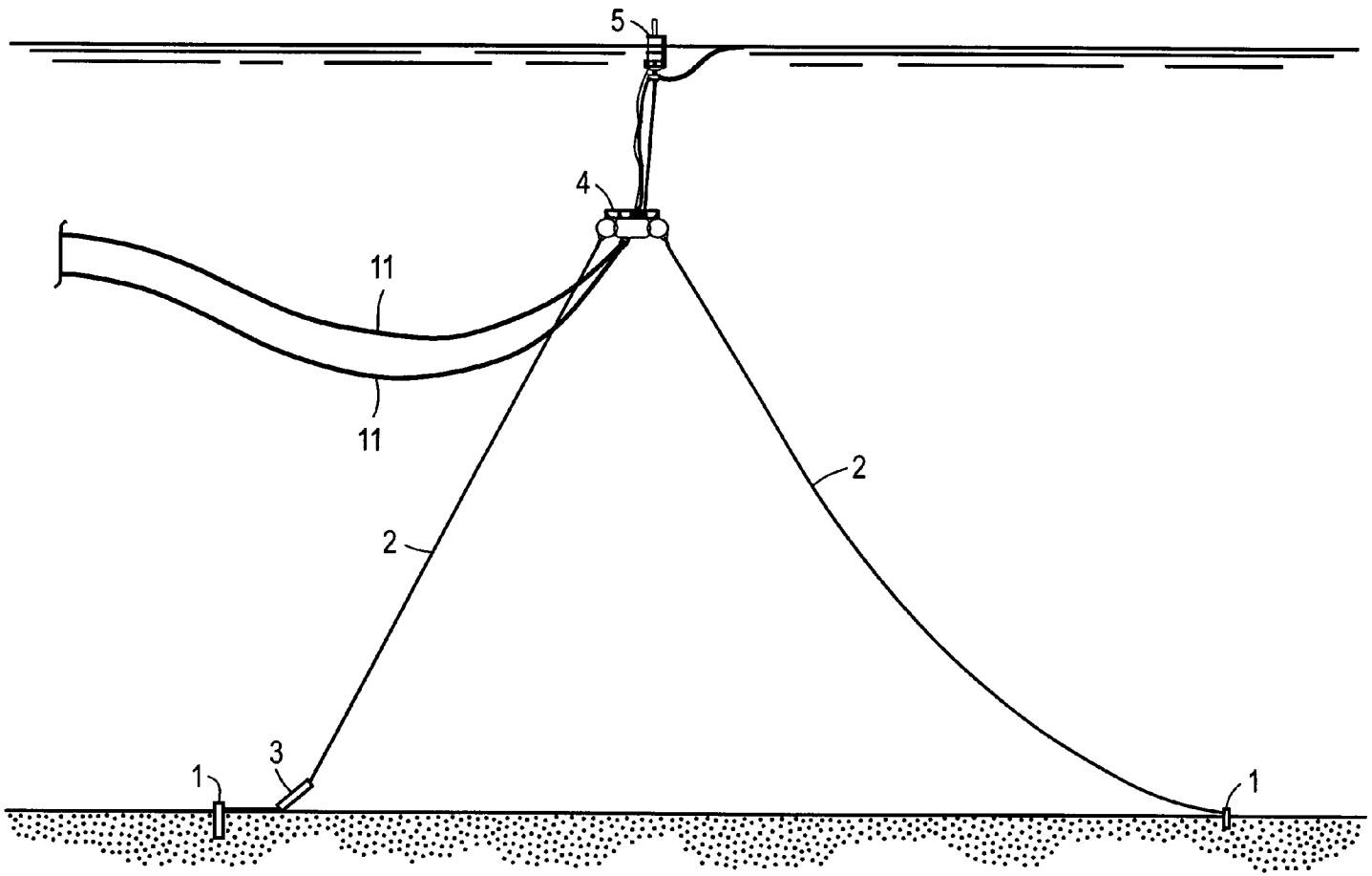
Figure 9:
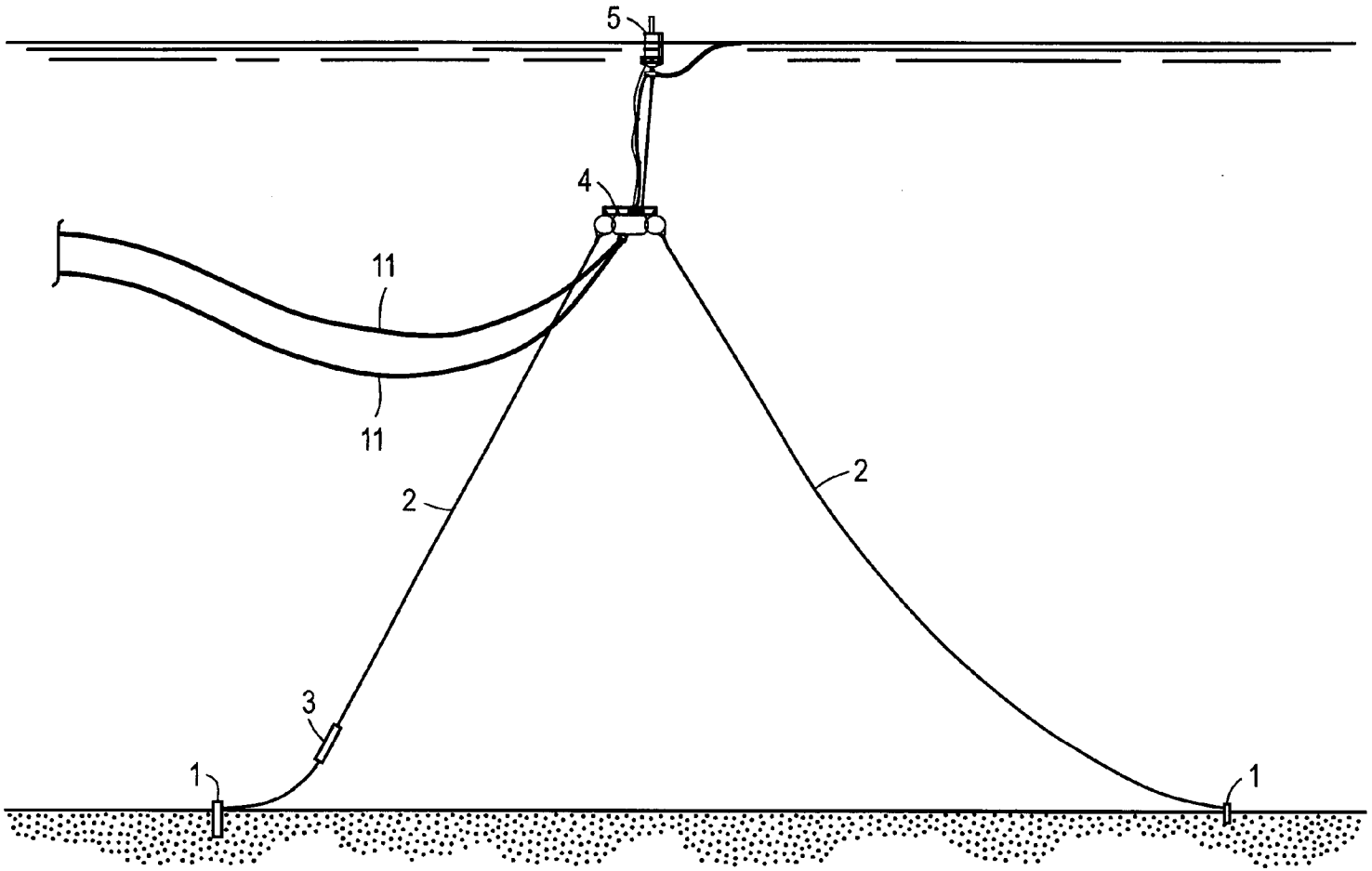

The FIGS. 7–9 illustrate how clump weights are raised from the seabed while the subsea buoy is lifted to the surface by ballast adjustment. One clump weight can be arranged on each anchor line, or two or more clump weights on each anchor line.

Figure 10:
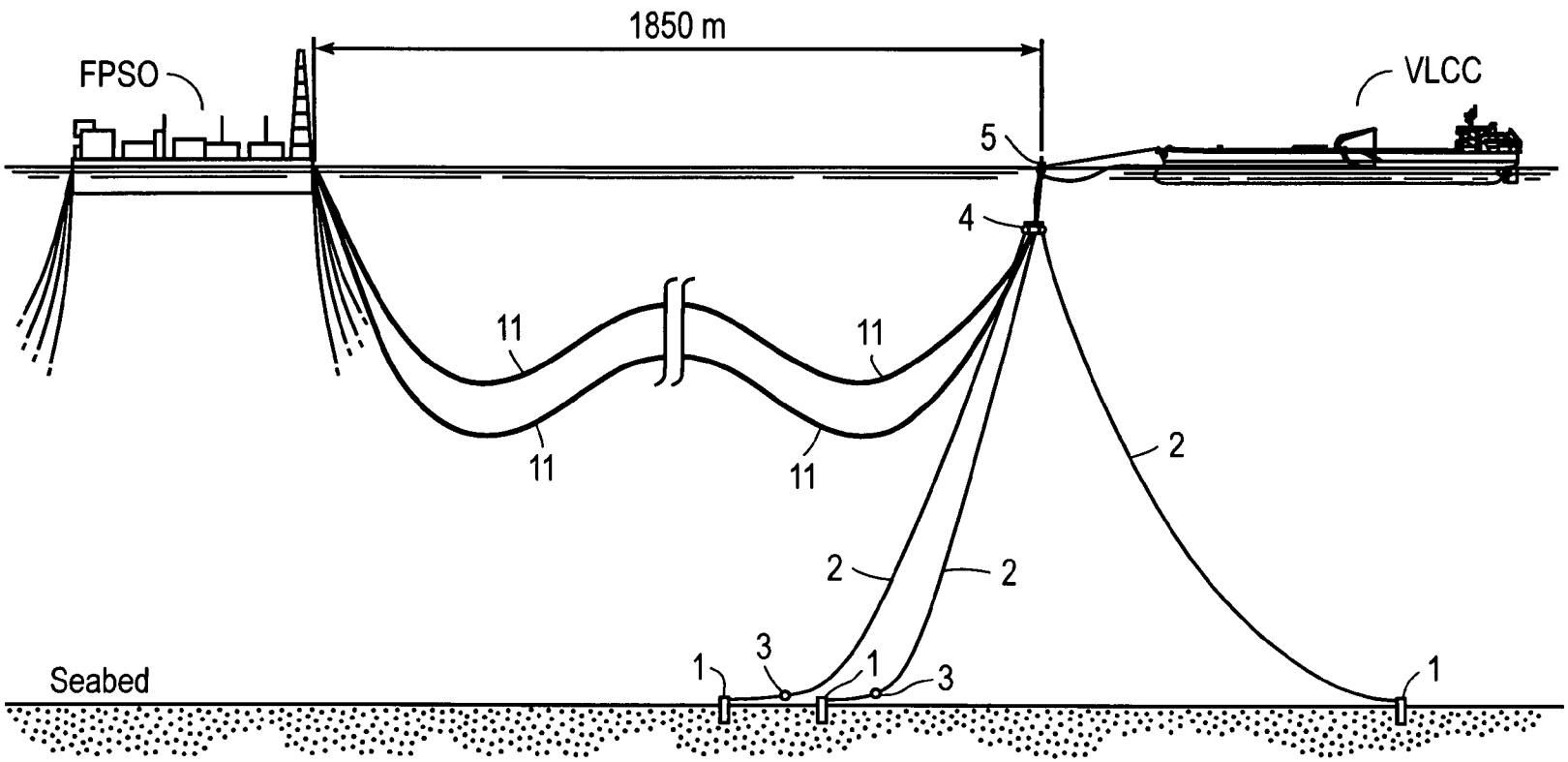
FIG. 10 illustrates the anchoring system according to the present invention, connected a production platform and a vessel that lies anchored and is loading.

FIG. 10 illustrates the anchoring system according to the present invention, connected to a production platform and a vessel that lies anchored and is loading.

Clump weights will not necessarily be arranged on all anchor lines, and on anchor lines with clump weights arranged more than one clump weight can preferably be provided.

The simplest embodiment of the anchoring system according to the present invention is one anchor with one anchor line including one clump weight, where the anchor line and one loading/unloading pipeline is suspended in a subsea buoy, without any regular surface buoy. For said embodiment the clump weight can lie on the seabed during normal operation, but it is lifted from the seabed if the subsea buoy by ballast adjustment is brought up to the surface.

The most preferred embodiment of the anchoring system according to the invention is, however, the embodiment as illustrated on the FIGS. 1 to 6, but with two clump weights on each anchor line with clump weights, because said embodiment appears to be most preferable with regard to technical effect and required investment. During all loading or unloading will for each anchor line with clump weights, at least one clump weight lie on the seabed while at least one clump weight is raised a short distance from the seabed. By damage on the surface buoy also the clump weights that are lifted a short distance above the seabed will be lowered such that they are laid on the seabed. If the subsea buoy is raised to the surface by ballast adjustment all the clump weights will be lifted from the sea bed and slack arranged in the anchoring lines will be stretched out.

Some typical dimensions for the components of the anchoring system according to the present invention are as follows: The subsea buoy is typically arranged at 30–50 m depth and has a typical diagonal span of 21.9 m and a width across flats of 19 m, and is assembled from a number of tanks, of which some tanks are sealed while others are arranged for ballasting. The surface buoy has a typical largest diameter of 6 m and a height of total 13.5 m, included the superstructure for access and control. The dimensioning of the anchoring system according to the invention is according to the anchoring forces as determined by the vessels and the impact of current, ice, growth, waves and wind, in addition to weight and weight variations for the loading/unloading pipelines.

What is claimed is:

1. An anchoring system for holding a vessel during loading or unloading, comprising:

a surface buoy;

an adjustably ballasted subsea buoy with swivel positioned at a subsea buoy depth at which the subsea buoy can be raised to the surface by adjusting the ballasting;

a mooring line connecting the surface buoy and the subsea buoy;

at least one anchor secured in the sea floor;

for each anchor, a respective anchor line extending from the anchor to the subsea buoy with slack sufficient to allow raising of the subsea buoy by adjusting the ballasting;

at least one vessel loading and unloading pipeline connected to the subsea buoy; and at least one first clump weight attached to at least one of the anchor lines, each first clump weight being positioned above the sea floor to provide a position-holding force at a vertical height such that, upon buoyant failure of any device from the subsea buoy to the surface buoy, including the surface buoy itself, the first clump weight will sink to the sea floor, the vertical height being no greater than the subsea buoy depth;

whereby, for an arbitrary load in the pipeline, the subsea buoy can by ballast adjustment be brought up to the surface and whereby the vessel can be connected or disconnected from the anchoring system all operating conditions without adjustments in the anchoring system.

2. An anchoring system as in claim 1, further comprising a second clump weight on at least one of the anchor lines on which the first clump weight is attached, in which, in a loading and unloading configuration, the second clump weight is positioned below the first clump weight at most in close proximity to the sea floor.

3. Anchoring system according to claim 2, comprising six anchors arranged as spread anchoring, with two clump weights on at least four of the anchor lines.

4. Anchoring system according to claim 1, characterized in that the loading/unloading pipelines and the anchor lines are arranged from the subsea buoy to the surface buoy and therefrom to the vessel.

5. Anchoring system according to claim 1, characterized in that the location of the subsea buoy between a lowest vertical position and a highest normal vertical position while loading or unloading about 5 meters.

6. Anchoring system according to claim 1, characterized in that the surface buoy is ballastable by bringing in/out air or water.

7. Anchoring system according to claim 6, further characterized in that the ballast of the subsea buoy is controlled from the surface via a cable or acoustic signals from the surface buoy.

8. Anchoring system according to claim 1, characterized in that the subsea buoy is located deeper than a largest draught for vessels that are to use the anchoring system.

9. Anchoring system according to claim 1, characterized in that a maximum allowable variation in buoyancy for loading/unloading pipelines is at least about 200000 kg.

* * * * *